US008519646B2

(12) United States Patent
Lin

(10) Patent No.: US 8,519,646 B2
(45) Date of Patent: Aug. 27, 2013

(54) CONTAINER LID

(75) Inventor: Tsong-Yow Lin, Taichung Hsien (TW)

(73) Assignee: THN Shong Industrial Co., Ltd., Taichung Hsien (TW)

( * ) Notice: Subject to any disclaimer, the term of this patent is extended or adjusted under 35 U.S.C. 154(b) by 461 days.

(21) Appl. No.: 12/873,479

(22) Filed: Sep. 1, 2010

(65) Prior Publication Data

US 2012/0048854 A1 Mar. 1, 2012

(51) Int. Cl.
*B65D 55/00* (2006.01)

(52) U.S. Cl.
USPC ..... 318/266; 318/14; 318/15; 318/286; 49/40; 49/42; 49/93

(58) Field of Classification Search
USPC ..... 318/264–266, 272, 275, 277, 282, 318/286, 466–469, 626, 9–15; 49/24, 25, 49/40, 42, 73.1, 82.1, 86.1, 89.1, 93, 94, 49/116, 197, 366, 371, 463
See application file for complete search history.

(56) References Cited

U.S. PATENT DOCUMENTS

| | | | | |
|---|---|---|---|---|
| 4,981,275 | A * | 1/1991 | Sheu | 248/147 |
| 4,996,467 | A * | 2/1991 | Day | 318/480 |
| 5,609,758 | A * | 3/1997 | Hwang | 210/244 |
| 5,797,497 | A * | 8/1998 | Edwards | 209/570 |
| 6,150,939 | A * | 11/2000 | Lin | 340/568.1 |
| 6,519,130 | B1 * | 2/2003 | Breslow | 361/170 |

FOREIGN PATENT DOCUMENTS

WO WO2006/084774 A1 8/2006

* cited by examiner

*Primary Examiner* — Bentsu Ro
(74) *Attorney, Agent, or Firm* — Alan Kamrath; Kamrath IP Lawfirm, P.A.

(57) ABSTRACT

A container lid is adapted to be releasably mounted on a container and includes a base, a control mechanism bore on the base, and first and second hoods pivotally mounted and bore on the base. The control mechanism and the first and second hoods are within an outer circumferential edge of the base. The first hood is engaged with and driven to pivot by the control mechanism. Moreover, the first and second hoods are structurally connected to each other in a manner that the pivoting of the first hood would cause the second hood to pivot oppositely from the first hood.

12 Claims, 9 Drawing Sheets

CONTAINER LID

BACKGROUND OF THE INVENTION

1. Field of the Invention

The present invention relates to a container lid which includes a sensing system and a transmission system actuated to cause the container lid to move to an open position in response to a signal from the sensing system.

2. Description of the Related Art

A container including a lid which can open automatically to allow the user to throw things into the container is known and is available in the market. Such container generally includes a sensor and a motor, and the motor is installed to the container, either inside or outside.

Patent WO2006/084774 shows a waste collector including a container and a lid mounted above an opening of the container in order to close the opening. The lid opens automatically when a sensor detects an approach of an object and is driven by an electrically powered transmission assembly. The transmission assembly includes a motor mounted inside a cover disposed on a side of the lid. Further, a spring is used to cause the lid to return to an unopened position. The waste collector is characterized in that the motor is disposed outside the container, and it operates an actuating member to move upwardly and downwardly for operably moving a T member to open and close the lid.

When removing the lid from the container for the purpose of emptying trash inside the container or arranging a bag inside the container, it is difficult to carry and transport the lid in a balanced state, and the lid is likely to drop inadvertently. The lid and the motor are damaged if dropped. Furthermore, because the motor and the cover project outside the container, they are liable to be bumped easily, and the lid has an increased volumetric size, which results in an increased packaging cost.

The present invention is, therefore, intended to obviate or at least alleviate the problems encountered in the prior art.

SUMMARY OF THE INVENTION

According to the present invention, a container lid is adapted to be releasably mounted on a container including a base adapted to be releasably mounted on the container in order to allow the container lid to be releasably supported on the container. The base includes a hole extending therethrough and adapted to align with and communicate with an opening of the container when the container lid is supported on the container. The container lid also includes a control mechanism mounted and bore on the base and disposed within a circumferential edge thereof. The control mechanism includes a circuit board, a motor, a transmission system, and a sensing system. The container lid further includes first and second hoods pivotally mounted and bore on the base and disposed within the circumferential edge thereof. The first hood is engaged with and driven to pivot by the control mechanism. Moreover, the first and second hoods are structurally connected to each other in a manner so that the pivoting of the first hood would cause the second hood to pivot oppositely from the first hood. Additionally, the first and second hoods are arranged symmetrically and disposed above the hole and moveable between a first operation position such that the first and second hoods cooperate to prevent a foreign object to pass therebetween and a second operation position such that the first and second hoods are apart and have a gap therebetween through which the foreign object is adapted to be passed and moves into the hole.

It is an object of the present invention to provide a container lid that the carrier can carry easily and stably.

It is another object of the present invention to provide a container lid that resolves the problem of having an increased volumetric size, which results in an increased packaging cost.

DETAILED DESCRIPTION OF THE PREFERRED EMBODIMENTS

Figure 1:
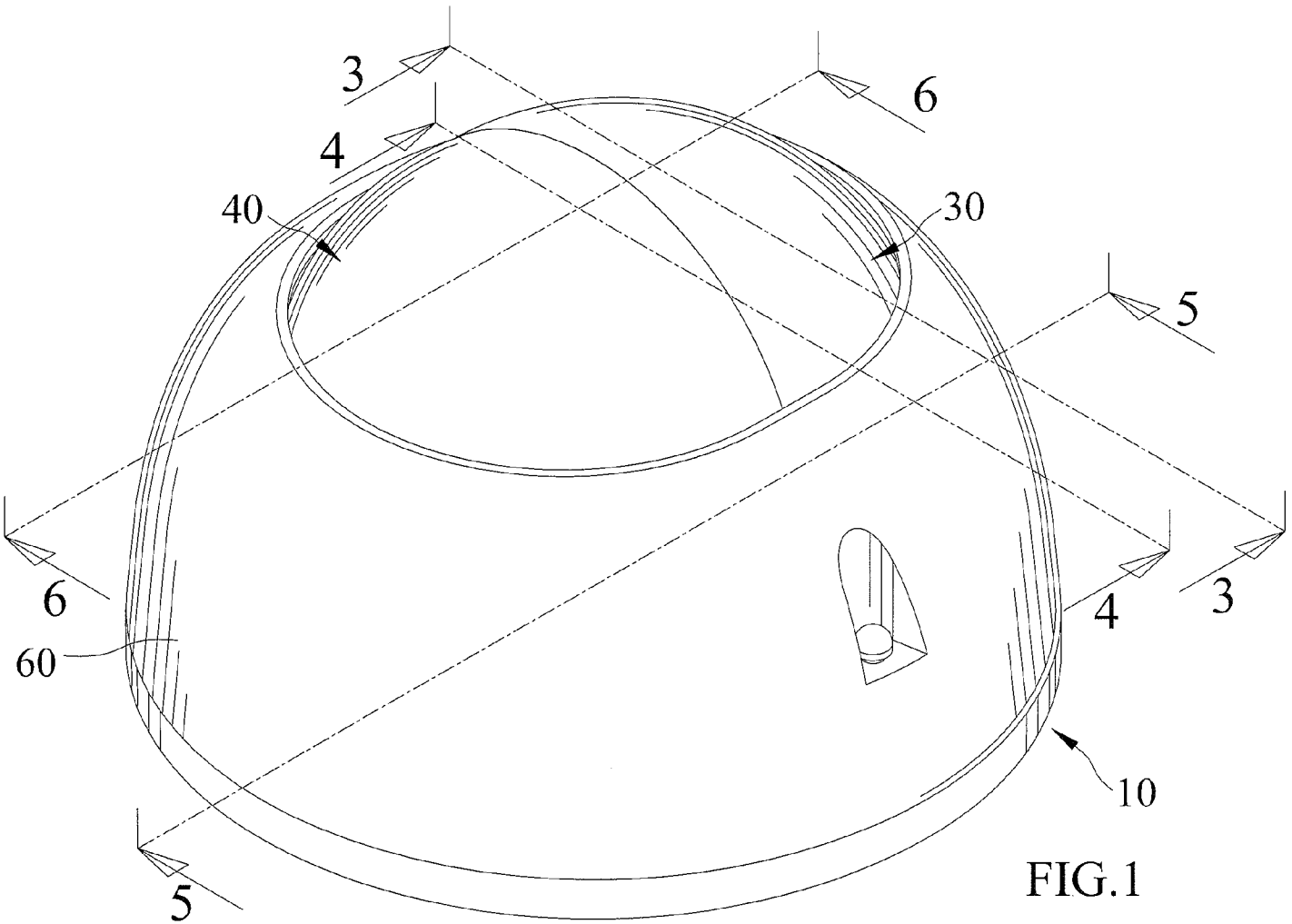
FIG. 1 is a perspective view of a container lid in accordance with the present invention.

Referring to the drawings, a container lid in accordance with the present invention includes a base 10, a control mechanism 20, two hoods, i.e. first and second hoods 30 and 40, two resilient members 50 and a sheath 60. The base 10 bears the control mechanism 20, the first and second hoods 30 and 40 and the sheath 60 and is adapted to releasably mount on a container in order to allow the container lid to be releasably supported on the container.

The base 10 includes a circumferential edge 101, a hole 11 extending therethrough, and a wall 111 delimiting the hole 11 and disposed within the circumferential edge 101. The hole 11 is adapted to align and communicate with an opening of the container when the container lid is supported on the container. The wall 111 includes first, second, third and fourth receiving sections 12, 13, 14 and 15 defined thereon. The first hood 30 engages the first and third receiving sections 12 and 14, and the second hood 40 engages the second and fourth receiving sections 13 and 15, respectively. The first and second receiving sections 12 and 13 are adjacent to each other. The third and fourth receiving sections 14 and 15 are adjacent to each other. Also, the first and third receiving sections 12 and 14 oppose each other, and the second and fourth receiving sections 13 and 15 oppose each other, respectively. Furthermore, the first, second, third and fourth receiving sections 12, 13, 14 and 15 are recessed from a top edge of the wall 111, and each has an arcuate cross section.

Figure 2:
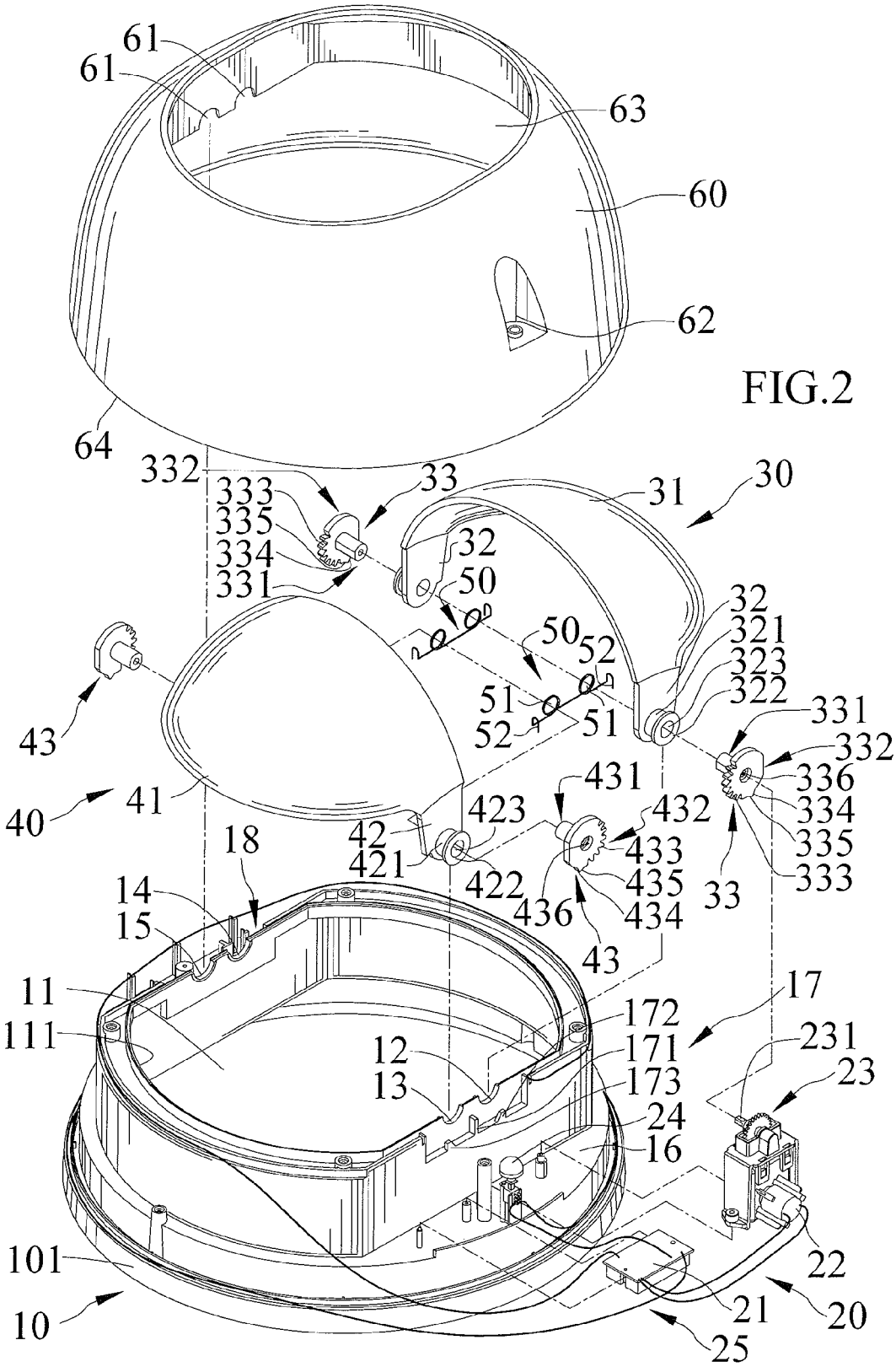
FIG. 2 is an exploded perspective view of the container lid shown in FIG. 1.
Figure 3:
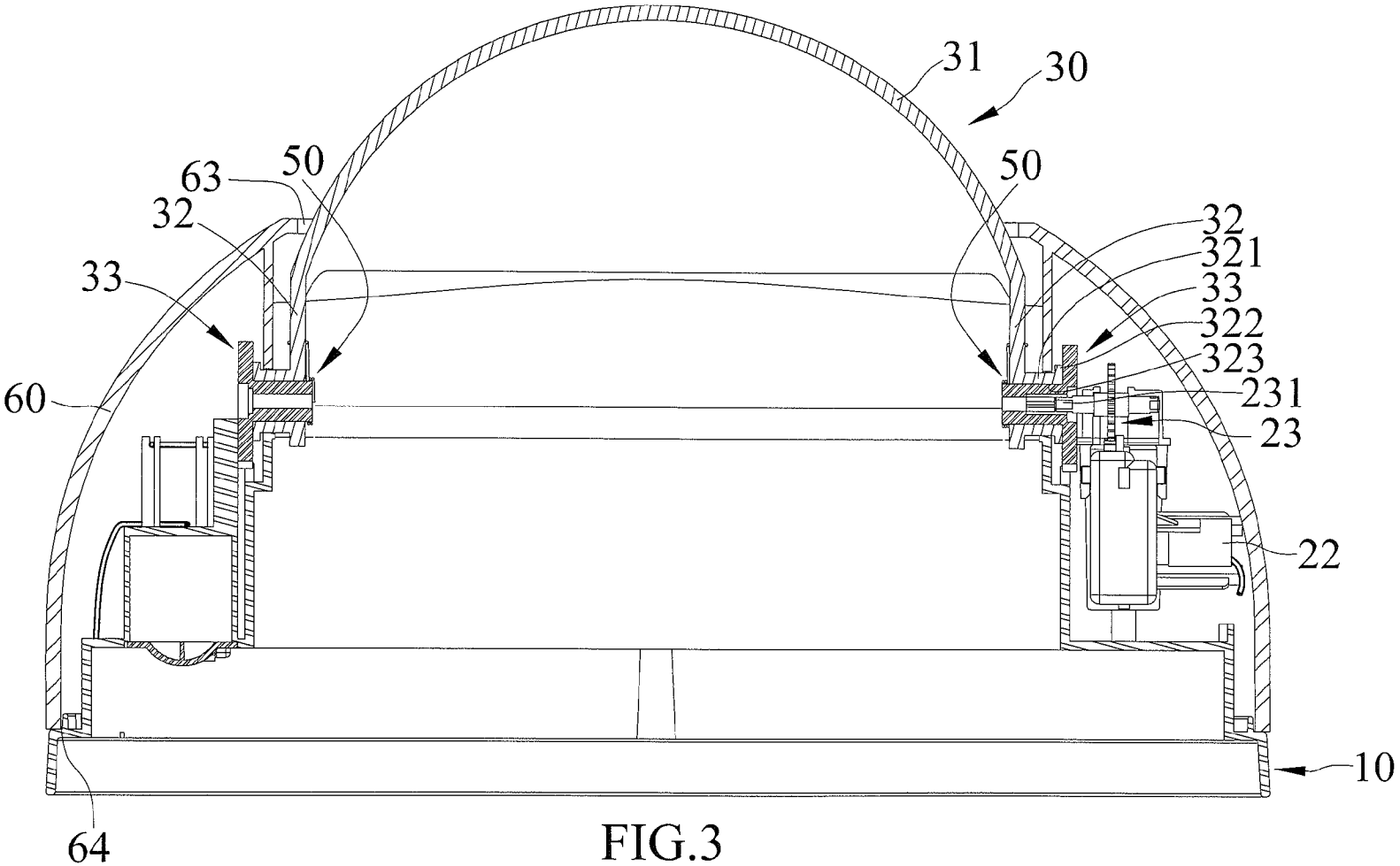
FIG. 3 is a cross-sectional view of the container lid taken along line 3-3 of FIG. 1.
Figure 4:
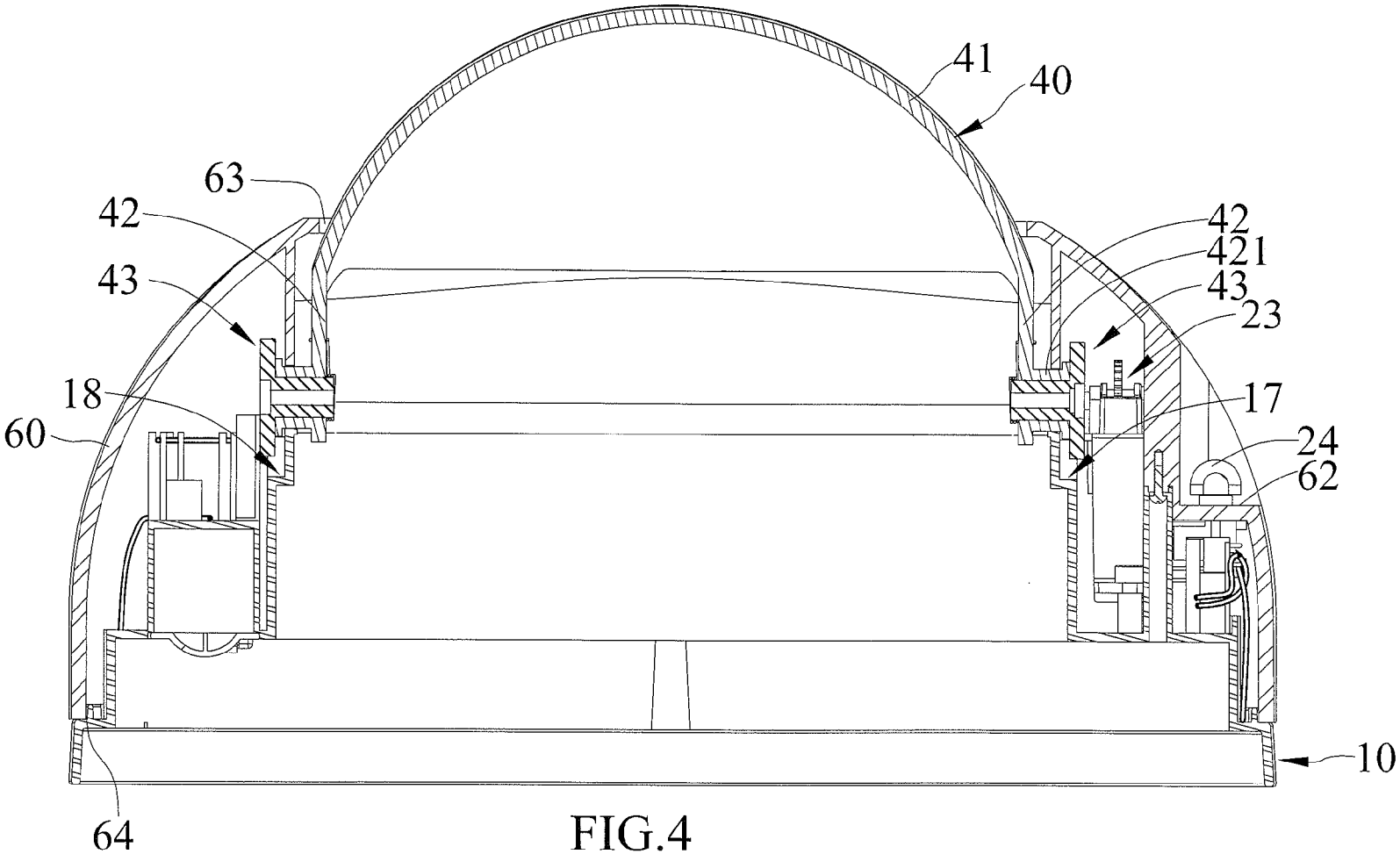
FIG. 4 is a cross-sectional view of the container lid taken along line 4-4 of FIG. 1.
Figure 5:
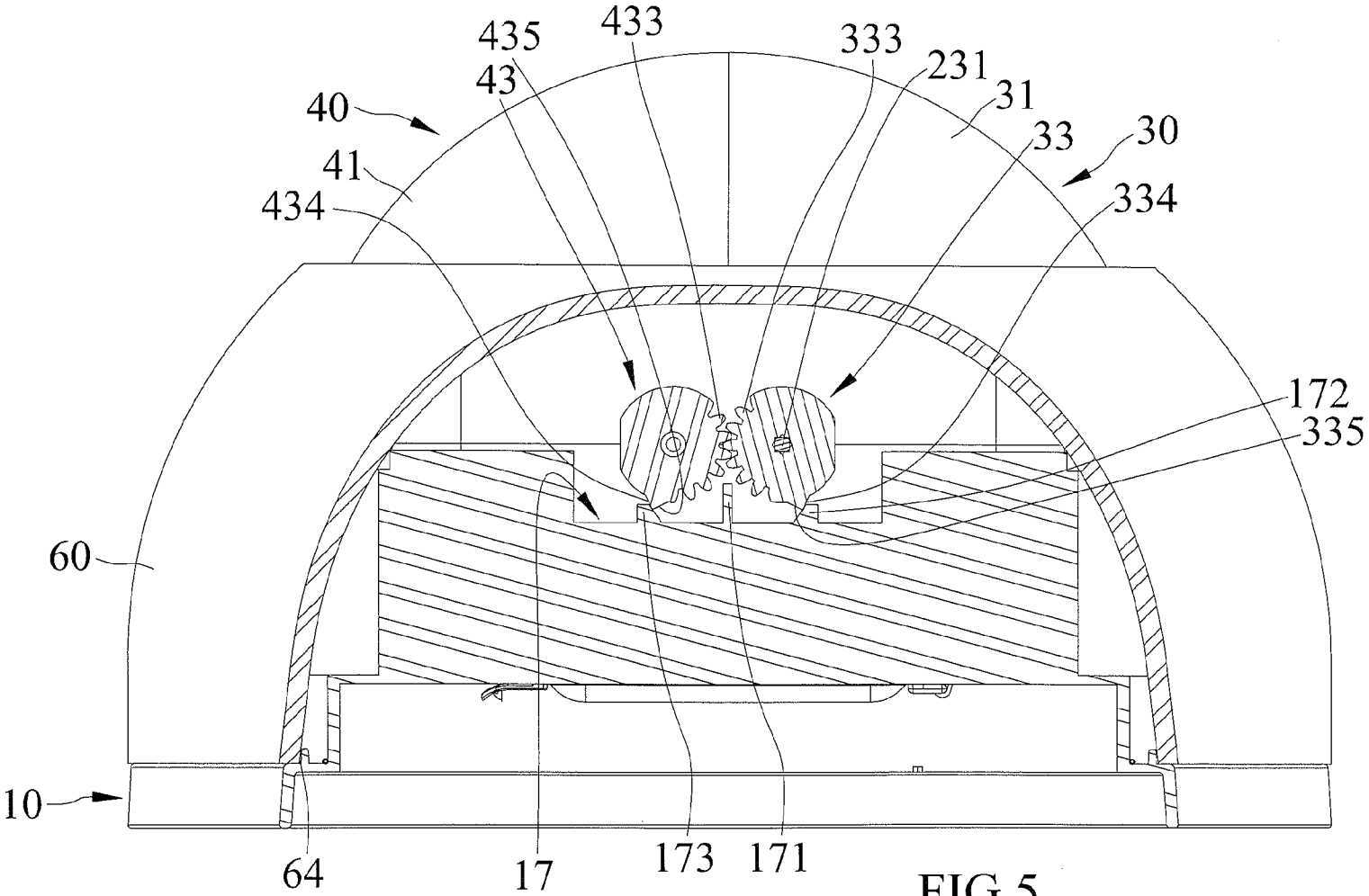
FIG. 5 is a cross-sectional view of the container lid taken along line 5-5 of FIG. 1.
Figure 6:
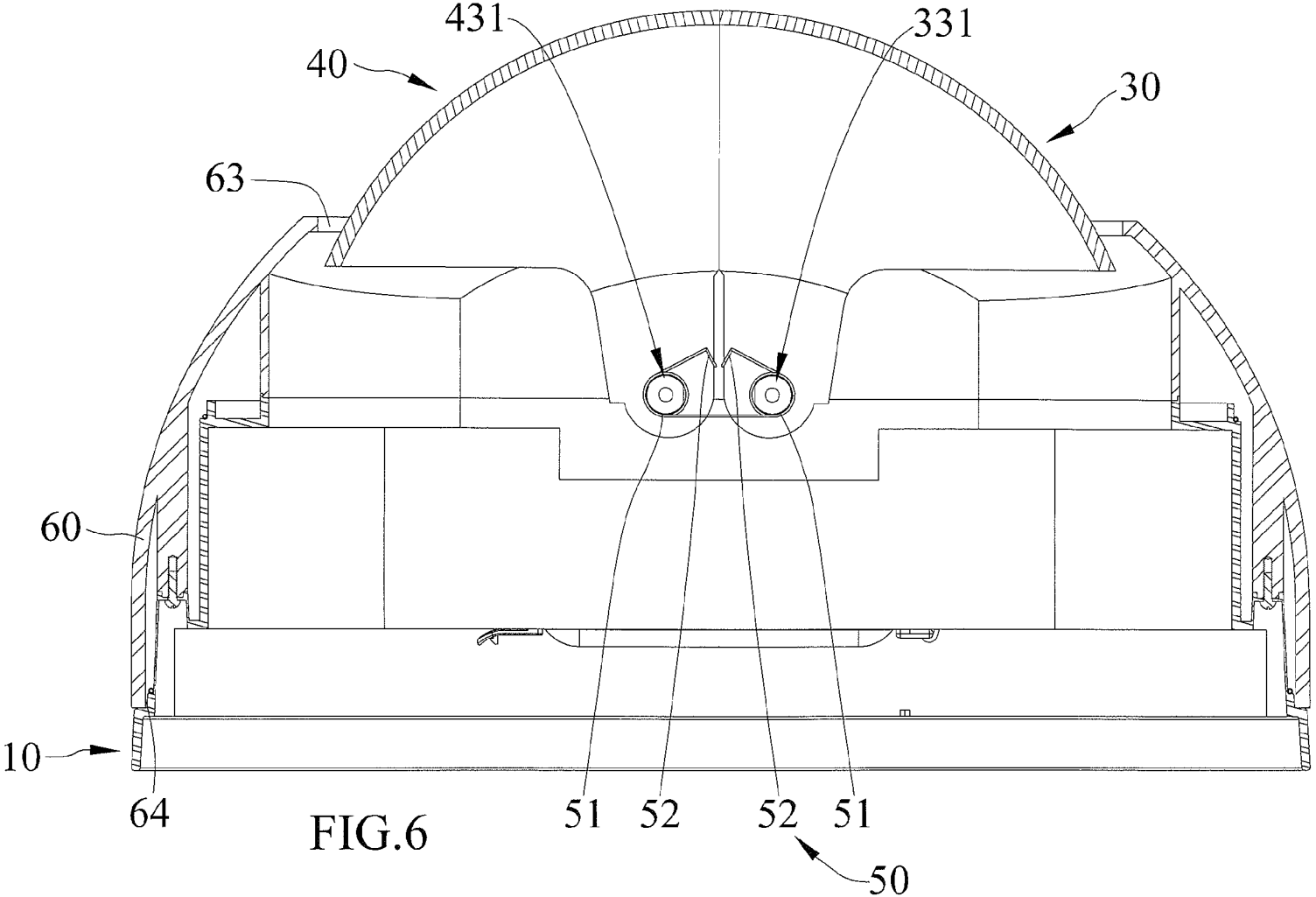
FIG. 6 is a cross-sectional view of the container lid taken along line 6-6 of FIG. 1.
Figure 7:
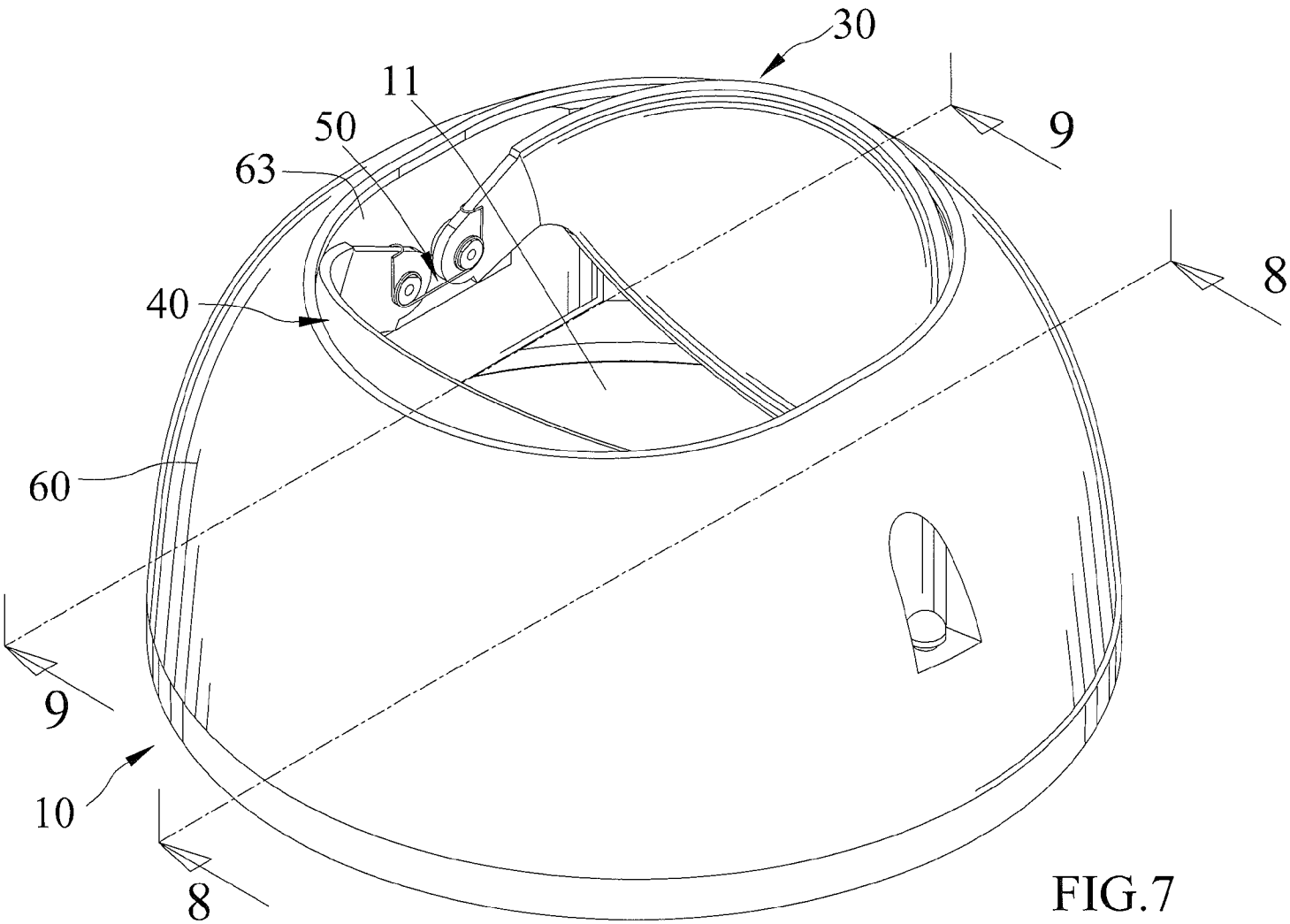
FIG. 7 is another perspective view showing the container lid in another operation position.
Figure 8:
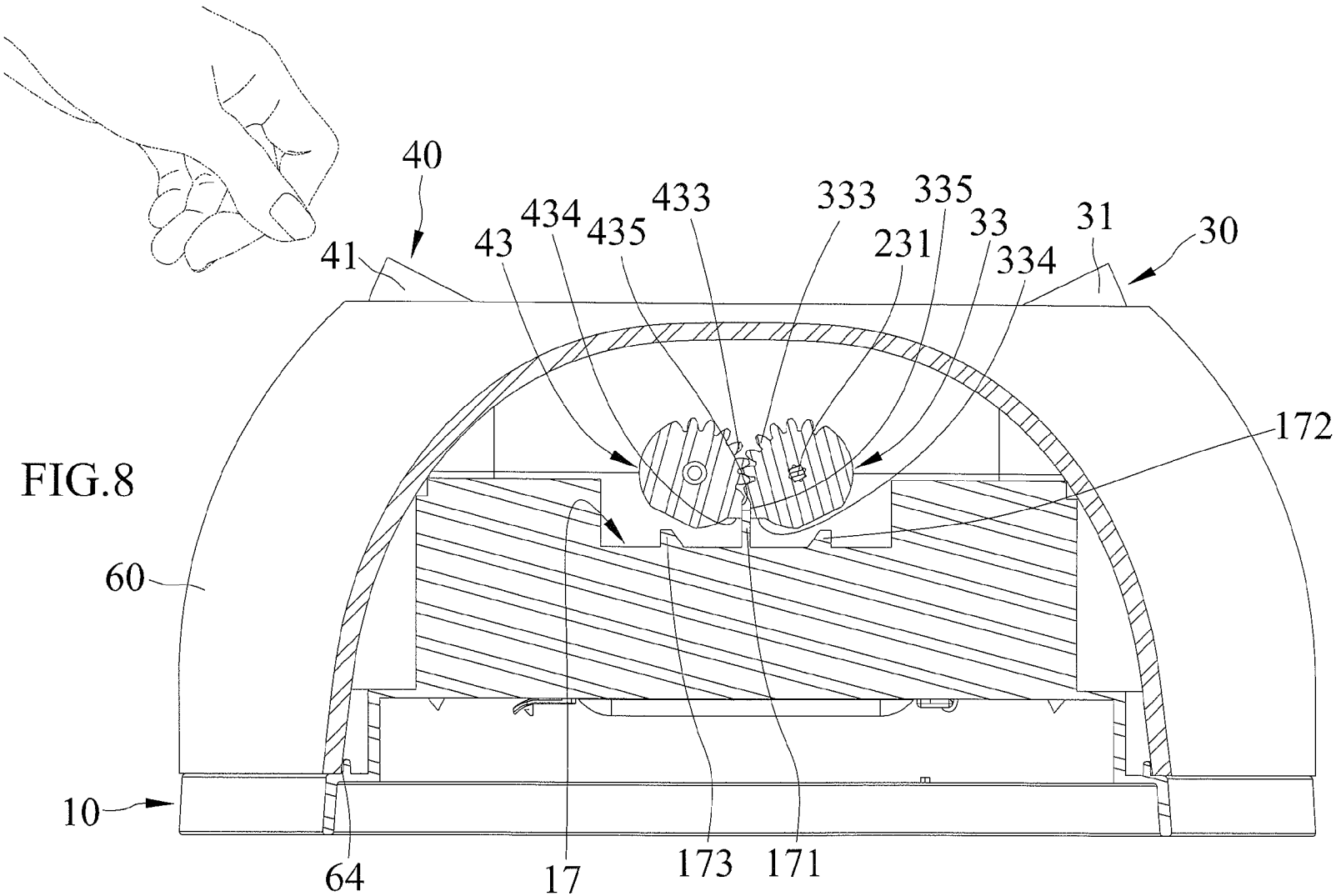
FIG. 8 is a cross-sectional view of the container lid taken along line 8-8 of FIG. 7 and shows the lid in this operation position in response to an approaching of an object, a hand, detected by a sensing system thereof, with the hand shown in phantom.
Figure 9:
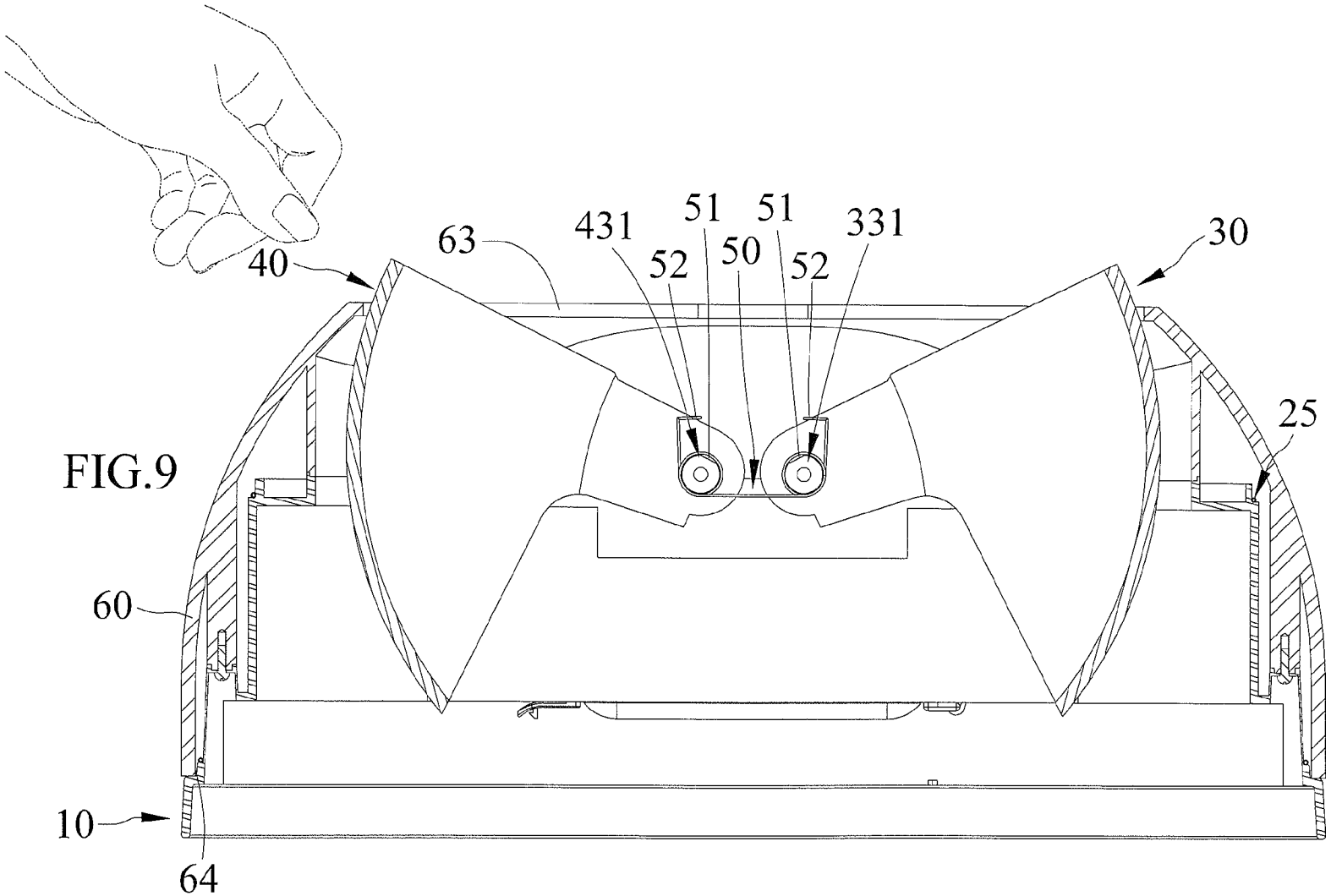
FIG. 9 is another cross-sectional view of the container lid taken along line 9-9 of FIG. 7.

The base 10 further includes an engaging section 16, and first and second accommodating sections 17 and 18. The engaging section 16 extends between the wall 111 and the circumferential edge 101. The first accommodating section 17 is adjacent to the first and second receiving sections 12 and 13 and includes first, second and third stopping structures 171, 172 and 173. The first, second and third stopping structures 171, 172 and 173 align with one another, and the first stopping section 171 is disposed between the second and third stopping structures 172 and 173. The second accommodating section 18 is adjacent to the third and fourth receiving sections 14 and 15 and includes first, second and third stopping structures (they are blocked in FIG. 2 due to an angle of the drawing). The first, second and third stopping structures of the second accommodating section 18 align with one another, and the first stopping structure is disposed between the second and third stopping structures.

The control mechanism 20 is engaged with the first hood 30 in order to cause the first hood 30 pivotally connected to the base 10 to pivot and to prevent the need for the user to exert a force for operably moving the first hood 30, so the first hood 30 can be moved "automatically". Additionally, the second hood 40, which is pivotally connected to the base 10, is structurally connected to the first hood 30 in a manner that the pivoting of the first hood 30 would cause the second hood 40 to pivot. Moreover, the control mechanism 20 is disposed on the engaging section 16 of the base 10 and includes a circuit board 21, a motor 22, a transmission system 23, a switch 24 and a sensing system 25. In an event that an object approaches the container lid, the sensing system 25 would be actuated to generate a signal for the circuit board 21. The sensing system 25 may be a thermal-sensing type, or a touch-sensing type, an electrostatic-sensing type. However, other types of sensing systems 25 are within the scope of the invention. Then, the circuit board 21 makes the motor 22 operate to drive the transmission system 23. The transmission system 23 is engaged with the first hood 30 to drive the first hood 30. Specifically, the transmission system 23 includes a spindle 231 engaged with the first hood 30. Furthermore, the switch 24 is utilized to selectively turn "on" the control mechanism 20, such that the sensing system 25 is responsive the motor 22 and such that the transmission system 23 is operable to move the first hood 30. Likewise, when the switch 24 is in a turn "off" state, the sensing system 25, the motor 22 and the transmission system 23 are in an idle condition.

The first hood 30 includes a covering section 31 and two connecting sections 32. The covering section 31 extends between the two connecting sections 32. Each connecting section 32 includes a neck 321, a flange 322 and a bore 323 defined thereon. The bore 323 is of a non-circular cross section and extends through the neck 321 and the flange 322. The first hood 30 further includes two engaging members 33 mounted on the two connecting sections 32, respectively. Each engaging member 33 includes an axle 331 and a drive section 332. The axle 331 is of a non-circular cross section. The drive section 332 includes a gear portion 333, first and second stopping portions 334 and 335, and an aperture 336. The aperture 336 extends through the drive section 332. The gear portion 333 and the first and second stopping portions 334 and 335 are defined on a circumferential edge of the drive section 332. Additionally, the gear portion 333 may be defined from a plurality of recesses or teeth.

In order to fix the engaging member 33 on the connecting section 32, the axle 331 of the engaging member 33 is inserted into and engaged in the bore 323 of the connecting section 32. Moreover, the engaging member 33 is prevented from rotating relative to the first hood 30 in that the cross sections of the bore 323 and axle 331 are non-circular.

The second hood 40 has the same configuration as the first hood 30 and includes a covering section 41 and two connecting sections 42. The covering section 41 extends between the two connecting sections 42. Each connecting section 42 includes a neck 421, a flange 422 and a bore 423 defined thereon. The bore 423 is of a non-circular cross section and extends through the neck 421 and the flange 422. The second hood 40 further includes two engaging members 43 mounted on the two connecting sections 42, respectively. Each engaging member 43 includes an axle 431 and a drive section 432. The axle 431 is of a non-circular cross section. The drive section 432 includes a gear portion 433, first and second stopping portions 434 and 435, and an aperture 336. The aperture 436 extends through the drive section 432. The gear portion 433 and the first and second stopping portions 434 and 435 are defined on a circumferential edge of the drive section 432. Additionally, the gear portion 433 may be defined from a plurality of recesses or teeth.

Likewise, in order to fix the engaging member 43 on the connecting section 42, the axle 431 of the engaging member 43 is inserted into and engaged in the bore 423 of the connecting section 42. Moreover, the engaging member 43 is prevented from rotating relative to the second hood 40 in that the cross sections of the bore 323 and axle 331 are non-circular.

As set forth, the first hood 30 is engaged with the transmission system 23 to drive the first hood 30. In this regard, the spindle 231 is engaged in the aperture 336 of one engaging member 333 of the first hood 30 in a manner such that the first hood 30 turns with the spindle 231 as the spindle 231 turns. As also set forth, the first and second hoods 30 and 40 are pivotally connected to the base 10, the first hood 30 engages with the first and third receiving sections 12 and 14, and the second hood 40 engages with the second and fourth receiving sections 13 and 15, respectively. In this regard, the first hood 30 engages with the first and third receiving sections 12 and 14 by having the two necks 321 rested on and engaged with the first and third receiving sections 12 and 14, respectively, and the second hood 40 engages with the second and fourth receiving sections 13 and 15 by having the two necks 421 rested on and engaged with the second and fourth receiving sections 13 and 15, respectively. Also, the first and second hoods 30 and 40 are structurally connected to each other and in a manner that the pivoting of the first hood 30 would cause the second hood 40 to pivot. In this regard, the first and second hoods 30 and 40 are structurally connected to each other by having the gear portions 333 of the two engaging members 33 of the first hood 30 engaged and interacting with the gear portions 433 of the two engaging members 43 of the second hood 40. Accordingly, the second hood 40 would pivot in a direction opposite to that of the first hood 30 as the first hood 30 pivots.

Furthermore, one engaging member 33 of the first hood 30 and one engaging member 43 of the second hood 40 are received in the first accommodating section 17, and the other engaging member 33 of the first hood 30 and the other engaging member 43 of the second hood 40 are received in the second accommodating section 18.

Moreover, the engaging member 33, which is received in the first accommodating section 17, includes the first and second stopping portions 334 and 335 disposed between the first and second stopping structures 171 and 172, and the engaging member 43, which is received in the first accommodating section 17, includes the first and second stopping portions 434 and 435 disposed between the first and third stopping structures 171 and 173. Likewise, the engaging member 33, which is received in the second accommodating section 18, includes the first and second stopping portions 334 and 335 disposed between the first and second stopping structures thereof, and the engaging member 43, which is received in the second accommodating section 18, includes the first and second stopping portions 434 and 435 disposed between the first and third stopping structures thereof.

The first and second hoods 30 and 40 are arranged symmetrically, disposed above the hole 11 and moveable between a first operation position such that the first and second hoods 30 and 40 cooperate to prevent a foreign object to pass therebetween and a second operation position such that the first and second hoods 30 and 40 are apart and have a gap therebetween through which the foreign object is adapted to be passed and moves into the hole. Accordingly, the first and second hoods 30 and 40 are in the second operation position to allow an object to pass the first and second hoods 30 and 40 and into the hole 11. Furthermore, in order to facilitate the first and second hoods 30 and 40 stopping in the predetermined first operation position, the first stopping portion 334 is abutted against the second stopping structure 172, and the first stopping section 434 is abutted against the third stopping structure 173, respectively. Additionally, the second stopping portions 335 and 435 are disengaged from the first stopping structure 171 in this instance. Moreover, in order to facilitate the first and second hoods 30 and 40 stopping in the predetermined second operation position, the second stopping portions 335 and 435 are abutted against the first stopping structure 171. Additionally, the first stopping portion 334 is disengaged from the second stopping structure 172 and the first stopping portion 434 is disengaged from the third stopping structure 173, respectively.

Each resilient member 50 includes two first clenching sections 51 and two second clenching sections 52. The two first clenching sections 51 are formed between two terminal ends of the resilient member 50, and the second clenching sections 52 are formed on the two terminal ends thereof, respectively. Furthermore, the two resilient members 50 are engaged with the first and second hoods 30 and 40. In this regard, the two first clenching sections 51 of one resilient member 50 are looped on the axles 331 and 431 of the engaging members 33 and 43 received in the first accommodating section 17, respectively, and the two second clenching sections 52 thereof are retained on peripheral edges of the associated connecting sections 32 and 42, respectively. The two first clenching sections 51 of the other resilient member 50 are looped on the axles 331 of the engaging members 33 and 43 received in the second accommodating section 18, respectively, and the two second clenching sections 52 thereof are retained on peripheral edges of the associated connecting sections 32 and 42, respectively. Moreover, the two resilient member 50 are tensioned when the first and second hoods 30 and 40 are moved from the first operation position to the second operation position and facilitate the first and second hoods 30 and 40 moving from the second operation position to the first operation position as it springs back.

The sheath 60 includes a peripheral edge including inner and outer sides. Four retaining sections 61 are defined on the inner side. A receptacle 62 is defined on the outer side. The sheath 60 further includes first and second orifices 63 and 64 extending through the peripheral edge thereof. Furthermore, the sheath 60 is mounted on the base 10 and covers the control mechanism 20 and the first and second hoods 30 and 40 in order to protect and retain them as well as enable the container lid to have a sleek outlook. The sheath 60 is mounted on the base 10. The peripheral edge thereof includes a bottom rim disposed along and corresponding to the circumferential edge 101 of the base 10, and the bottom rim delimits the second orifice 64 and has the largest diametrical size. The four retaining sections 61 are disposed corresponding to and cooperate with the first, second, third and fourth receiving sections 12, 13, 14 and 15 to further prevent the first and second hoods 30 and 40 from disengagement from the first, second, third, and fourth receiving sections 12, 13, 14 and 15. In addition, the switch 24 of the control mechanism 20 is exposed from the receptacle 62 for the user to see and to operate, and the first and second hoods 30 and 40 are partially exposed from the first orifice 63.

In view of the foregoing, the control mechanism 20, and the first and second hoods 30 and 40 are disposed within the circumferential edge 101 of the base 10, which enables the container lid to be carried easily and stably.

While the specific embodiments have been illustrated and described, numerous modifications come to mind without significantly departing from the spirit of invention, and the scope of invention is only limited by the scope of accompanying claims.

What is claimed is:

1. A container lid is adapted to be releasably supported on a container comprising:

a base adapted to be releasably mounted on the container in order to allow the container lid to be releasably supported on the container, with the base including a hole extending therethrough and adapted to align with and communicate with an opening of the container when the container lid is supported on the container;

a control mechanism mounted and bore on the base and disposed within a circumferential edge thereof, with the control mechanism including a circuit board, a motor, a transmission system, and a sensing system; and first and second hoods pivotally mounted and bore on the base and disposed within the circumferential edge thereof, with the first hood engaged with and being driven to pivot by the control mechanism, with the first and second hoods structurally connected to each other in a manner that pivoting of the first hood would cause the second hood to pivot oppositely from the first hood, with the first and second hoods arranged symmetrically and disposed above the hole and moveable between a first operation position with the first and second hoods cooperating to prevent a foreign object to pass therebetween and a second operation position with the first and second hoods being apart and having a gap therebetween through which the foreign object is adapted to be passed and moves into the hole;

wherein the base includes first, second, third and fourth receiving sections defined thereon, with the first hood including two first connecting sections pivotally engaging the first and third receiving sections respectively, with the second hood including two second connecting sections pivotally engaging the second and fourth receiving sections respectively.

2. The container lid as claimed in claim 1, wherein the first and second receiving sections are adjacent to each other and the third and fourth receiving sections are adjacent to each other, wherein the first and third receiving sections oppose each other, and wherein the second and fourth receiving sections oppose each other.

3. The container lid as claimed in claim 1, wherein the first hood includes a first engaging member including a first gear portion defined thereon and the second hood includes a second engaging member including a second gear portion defined thereon engaged and interacting with the first gear portion.

4. The container lid as claimed in claim 3, wherein the first and second gear portions are defined from a plurality of recesses or teeth.

5. The container lid as claimed in claim 3, wherein the control mechanism is engaged with the first hood by engaging a rotatable spindle of the transmission system with an aperture defined in the first engaging member in a manner that the first hood turns with the spindle as the spindle turns.

6. The container lid as claimed in claim 3 further comprising a resilient member engaged with the first and second hoods.

7. The container lid as claimed in claim 6, wherein the resilient member includes two first clenching sections and two second clenching sections, with the two first clenching sections formed between two terminal ends of the resilient member, with the second clenching sections formed on the two terminal ends respectively, with the first and second engaging members including first and second axles respectively on which the two first clenching sections are looped on, and with the two second clenching sections retained on peripheral edges of the two first connecting sections respectively.

8. The container lid as claimed in claim 7 further comprising a sheath mounted and bore on the base and covering the control mechanism and the first and second hoods, with the sheath including a peripheral edge defining inner and outer sides, with first and second orifices extending through the peripheral edge, with the first and second hoods partially exposed from the first orifice, and with the peripheral edge of the sheath including a bottom rim delimiting the second orifice and disposed along and corresponding to the circumferential edge of the base.

9. The container lid as claimed in claim 3, wherein the base includes a first accommodating section including first, second and third stopping structures, with the first stopping section disposed between the second and third stopping structures, with the first engaging member including first and second stopping portions disposed between the first and second stopping structures and the second engaging member including third and fourth stopping portions disposed between the first and third stopping structures, with the first stopping portion abutted against the second stopping structure and the third stopping section abutted against the third stopping structure respectively as well as the second and fourth stopping section disengaged from the first stopping structure when the first and second hoods are in the first operation position, with the first stopping section disengaged from the second stopping structure and the first stopping section disengaged from the third stopping structure respectively as well as the second and fourth stopping portions abutted against the first stopping structure when the first and second hoods are in the second operation position.

10. A container lid is adapted to be releasably supported on a container comprising:

a base adapted to be releasably mounted on the container in order to allow the container lid to be releasably supported on the container, with the base including a hole extending therethrough and adapted to align with and communicate with an opening of the container when the container lid is supported on the container;

a control mechanism mounted and bore on the base and disposed within a circumferential edge thereof, with the control mechanism including a circuit board, a motor, a transmission system, and a sensing system;

first and second hoods pivotally mounted and bore on the base and disposed within the circumferential edge thereof, with the first hood engaged with and driven to pivot by the control mechanism, with the first and second hoods structurally connected to each other in a manner that pivoting of the first hood would cause the second hood to pivot oppositely from the first hood, with the first and second hoods arranged symmetrically and disposed above the hole and moveable between a first operation position with the first and second hoods cooperating to prevent a foreign object to pass therebetween and a second operation position with the first and second hoods being apart and having a gap therebetween through which the foreign object is adapted to be passed and moves into the hole; and a resilient member engaged with the first and second hoods;

wherein the resilient member includes two first clenching sections and two second clenching sections, with the two first clenching sections formed between two terminal ends of the resilient member.

11. A container lid is adapted to be releasably supported on a container comprising:

a base adapted to be releasably mounted on the container in order to allow the container lid to be releasably supported on the container, with the base including a hole extending therethrough and adapted to align with and communicate with an opening of the container when the container lid is supported on the container;

a control mechanism mounted and bore on the base and disposed within a circumferential edge thereof, with the control mechanism including a circuit board, a motor, a transmission system, and a sensing system; and first and second hoods pivotally mounted and bore on the base and disposed within the circumferential edge thereof, with the first hood engaged with and driven to pivot by the control mechanism, with the first and second hoods structurally connected to each other in a manner that pivoting of the first hood would cause the second hood to pivot oppositely from the first hood, with the first and second hoods arranged symmetrically and disposed above the hole and moveable between a first operation position with the first and second hoods cooperating to prevent a foreign object to pass therebetween and a second operation position with the first and second hoods being apart and having a gap therebetween through which the foreign object is adapted to be passed and moves into the hole;

a sheath mounted and bore on the base and covering the control mechanism and the first and second hoods, with the sheath including a peripheral edge defining inner and outer sides, with first and second orifices extending through the peripheral edge, with the first and second hoods partially exposed from the first orifice, and with the peripheral edge of the sheath including a bottom rim delimiting the second orifice and disposed along and corresponding to the circumferential edge of the base.

12. The container lid as claimed in claim 11, wherein the control mechanism includes a switch utilized to selectively turn on the control mechanism, wherein the sensing system is responsive to the motor, and wherein the transmission system is operable to move the first hood, with the switch exposed from the sheath for the user to see and to operate.

* * * * *